United States Patent [19]

Hayashi

[11] 4,185,537

[45] Jan. 29, 1980

[54] TRIGGER DEVICE FOR AUTOMATIC GUN

[75] Inventor: Hisao Hayashi, Tokyo, Japan

[73] Assignee: Kabushiki Kaisha Kawaguchiya Hayashi, Tokyo, Japan

[21] Appl. No.: 855,667

[22] Filed: Nov. 29, 1977

[30] Foreign Application Priority Data

Dec. 11, 1976 [JP] Japan ..... 51-149158
Jun. 28, 1977 [JP] Japan ..... 52-76893

[51] Int. Cl.[2] ..... F41C 19/00
[52] U.S. Cl. ..... 89/145
[58] Field of Search ..... 42/69 B; 89/141, 144, 89/145

[56] References Cited

U.S. PATENT DOCUMENTS

| | | | |
|---|---|---|---|
| 1,511,509 | 10/1924 | Diehm | 89/145 |
| 1,790,320 | 1/1931 | Reising | 89/145 |
| 4,017,996 | 4/1977 | Liedke | 89/144 |

*Primary Examiner*—Stephen C. Bentley
*Attorney, Agent, or Firm*—Toren, McGeady and Stanger

[57] ABSTRACT

A trigger device for automatic gun provided with a connector piece which serves to engage a hammer with a sear and also is interlocked with a trigger to slide forward on a trigger guard inside a receiver in such a way as to disengage the hammer from the sear in direct response to the backward and forward movement of a breech block.

1 Claim, 9 Drawing Figures

TRIGGER DEVICE FOR AUTOMATIC GUN

BACKGROUND OF THE INVENTION

This invention relates to an improvement in the trigger device of an automatic gun.

In an automatic gun, a gas pressure developed when it is fired is utilized to cause a breech block inside a receiver to retract. The rearward movement of the breech block ejects a shell remaining in a barrel chamber. Then, concurrently with this ejection, the breech block moves forward to cause the next cartridge to come out from inside of a magazine to load the chamber therewith. Following this, a pulling action on a trigger causes a firing pin to be hit by a quick rotational uprising action of a hammer for next firing. After the firing, the hammer is again brought back to its initial position through the rearward movement of the breech block inside the receiver to complete preparation for further firing.

The above stated series of actions for automatic loading are performed in an extremely short period of time after firing a cartridge. Hence, a beginner shooter often continues to pull the trigger until next firing become ready after firing. Such continuous pulling tends to cause spontaneous firing of a cartridge. Thus, it has been necessary to have a safety mechanism for preventing such a spontaneous firing accident.

Accordingly, there have been provided many kinds of such safety mechanism including for example; A mechanism wherein a trigger is provided with two stages of hammer locking arrangement. The hammer is locked at first stage when it is tilled by the rearward movement of a breech block. Following this, when a trigger is released by a shooter's finger grip, the hammer locking is shifted to a second stage. In another example, a hammer is locked in a tilting state by a sear. Then, the hammer is released from the sear by a forward movement of a connector which takes place in response to a trigger. After firing, the connector is released from an interlocked relation to the sear by a certain mechanism until the breech block which moves back and forth inside a receiver comes back to its initial position. Of these known prior art safety arrangements, the former lacks interrelation between the forward movement of the breech block and shifting from one hammer locking position to another. As a result, spontaneous firing of a cartridge might take place if the hammer alone happens to shift to the second locking stage during a loading and unloading of a cartridge. In the case of the latter, the safety is secured because of the arrangement not to complete preparation for firing until the breech block comes back to its initial position. However, the arrangement for a continued release of the connector from the interlocked relation to the sear based on a pushing force of a hammer spring for rotative uprising of the hammer and the movement of a carrier in a cartridge operating mechanism results in a complex structure and thus causes an increase in the number of parts required. With such arrangement, therefore, the manufacturing cost increases.

SUMMARY OF THE INVENTION

It is therefore a general object of this invention to provide a trigger device for an automatic gun which eliminates the above stated shortcomings of the conventional devices with its high safety mechanism of a simple structure.

In the trigger device of this invention, there is provided a first engaging part at the forward position of a connector. With the connector sliding forward, the first engaging part engages with and turns a sear to swing it on to the forward position of the connector, the first engaging part being freely disengageable. At the rear end of the connector, there is provided a second engaging part which connects to a trigger through a given length of a free space provided in the vertical direction between the second engaging part and the trigger. There is also provided an urging spring which charges the connector with an upward pushing force. A link connected to the rear part of a breech block which slides back and forth inside a receiver disposed above the trigger device is provided with a guide face, which prevents the connector from swaying upward and guides it to slide forward when the breech block is stationary. Then, when the link moves away, the connector is released from its state of being prevented from swaying upward. In other words, the hammer is locked by the sear and, in direct relation to the back and forth movement of the breech block, the connector which slides forward over a trigger guard inside the receiver in response to the trigger causes the hammer to be released from its state of being locked by the sear.

Other objects and aspects of the invention will become apparent from the following description of preferred embodiments of the invention with reference to the accompanying drawings.

BRIEF DESCRIPTION OF THE DRAWINGS

The accompanying drawings illustrate embodiments of the trigger device of an automatic gun of the present invention.

DESCRIPTION OF THE PREFERRED EMBODIMENTS

Referring to the accompanying drawings, the details of embodiment examples of this invention are described as shown below.

EXAMPLE 1

Figure 1:
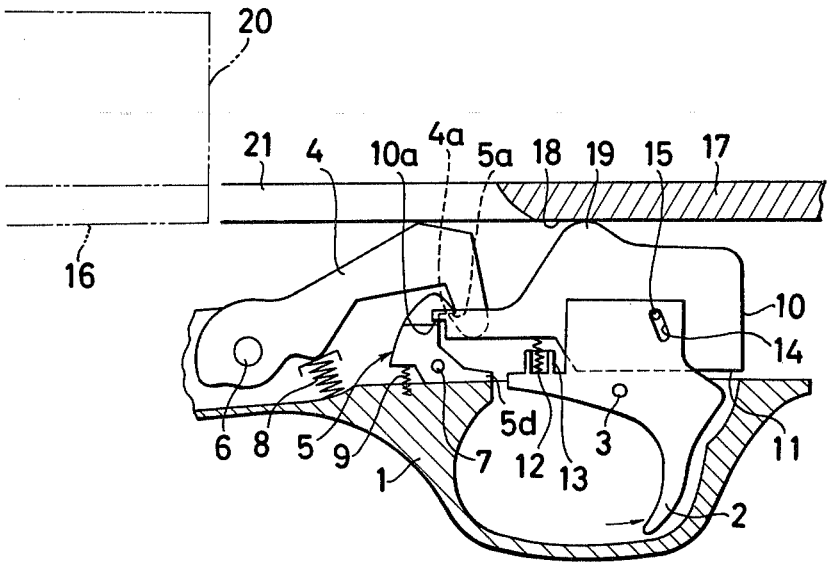
FIG. 1 is a vertical partially sectional view showing the trigger device.
Figure 2:
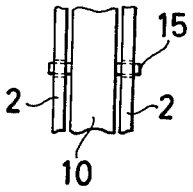
FIG. 2 is a plan view showing a part of a coupling part connecting a trigger to a connector.
Figure 3:
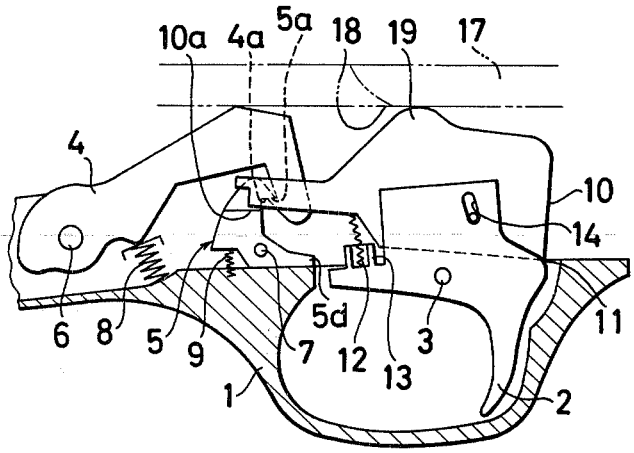
FIG. 3 is a side view showing the trigger device shown in FIG. 1 as in its operating state.

In FIG. 1, a reference numeral (1) indicates a trigger guard which is inserted into an unillustrated receiver; (2) indicates a trigger which is rotatably attached to the trigger guard (1) with a pin (3) to be rotated by a pulling force of a shooter in the direction of an arrow indicated; and (5) indicates a sear which is rotatably attached to the trigger guard (1) by a pin (7) with its upper swaying part being urged to turn backward by a rotational pushing force of a spring (9) and is arranged to be locked by having its leg portion (5*d*) in contact with the trigger guard (1). In the upper swaying part of the sear, there is formed a claw part (5*a*) which engages with a hooked part (4*a*) of a hammer (4) to lock the hammer (4) to prevent it from turning into an upright position. The hammer (4) is rotatably attached to the trigger guard (1) by a pin (6) and is arranged to be caused to move rotatively upwardly by a pushing force of a spring (8) while, as mentioned above, such upward rotation of the hammer is prevented as long as the hooked part (4*a*) of the hammer (4) is in engagement with the claw part (5*a*) of the sear (5). A reference numeral (10) indicates a connector. In the rear end portion of the connector, a pin 15 is securely attached and protrudes outwardly on both sides into loosely fitting engagement with a slot 14 located in the upper swaying part of the trigger (2). The slot 14 extends approximately in the vertical direction. In the forward end part of the connector (10), there is formed a stepped part (10*a*) which engages with the upper face edge in the upper swaying part of the sear (5). Further, in the upper middle part of the connector in the longitudinal direction thereof, there is formed a protrusion (19) which slides in contact with a guide face (18) of a link member (17). The link member (17) is disposed between a breech block (20) which is arranged to be moved back and forth by the gas pressure generated when a shotshell is fired and a recoil spring (unillustrated) which is disposed inside a stock. The link (17) is provided with a hole (21) which allows the hammer (4) to pass therethrough as it rotates upwardly and also with a guide face (18) which presses the connector (10) to bring the stepped part (10*a*) provided in the forward end part of the connector (10) into engagement with the sear (5).

In the lower face of the breech block (20), there is provided a groove (16) extending in the longitudinal direction thereof to permit insertion of the upper protrusion (19) of the connector (10) therein. The connector (10) is provided with a rear end edge engaging part (11) which is in contact with the trigger guard (1) in such a manner as to restrict the upward sway of the connector (10) to a given degree. A reference numeral (12) indicates an urging spring which is in contact with the middle part in the longitudinal direction of the connector (10) to impart an upward spring force to the connector (10), the spring (12) being disposed in a cylindrical part (13) formed on the trigger (2).

The above stated trigger device operates in the following manner:

Before firing, the parts in the trigger device are positioned as shown in FIG. 1. The upper protrusion (19) of the connector (10) is in contact with the guide face (18) of the link (17) and thus the upward sway of the connector (10) due to the pushing force of the spring (12) is restricted. The stepped part (10*a*) provided at the forward end of the connector is then in contact with the upper rear edge part of the sear (5).

When the trigger (2) is pulled, the upper swaying part of the trigger (2) moves the connector (10) forward through the pin (15) as the trigger rotates. The forward movement of the connector (10) causes the sear to sway against the pushing force of the spring (9) by this, the hammer (4) is released from its locked state in a tilting posture by the claw part (5*a*) of the sear (5). The hammer (4) rotates upwardly and hits an unillustrated firing pin disposed at the rear end face portion of the breech block (20) and a cartridge is fired thereby.

When the cartridge has been fired, the breech block 20 and the link (17) begin to retract inside the receiver to tilt the hammer (4) again. Then, the guide face (18) of the link (17) which has been restricting the upward sway of the connector (10) also retracts. This causes the hole (21) or the breech block (20) to be positioned above the upward protrusion (19) of the connector (10). The pushing force of the spring (12) then causes the connector (10) to sway upward to a given degree to disengage the forward end stepped part (10*a*) from the sear (5). Accordingly, the sear (5) is brought back to its initial position by the pushing force of the spring (9) and the forward end part of the connector (10) comes to take a posture of riding on the upper face of the sear (5). Since such a condition takes place due to the pushing force of the urging spring (12) regardless of the pulling action of the shooter on the trigger (2), the forward end stepped part (10*a*) of the connector (10) will not engage again with the sear (5) even when the trigger (2) is momentarily released from the trigger pulling action of the shooter due to the recoil of the gun or a shock resulting from firing.

When the breech block (20) retracts inside the receiver and then is caused to move forwardly by the recoil spring provided in the stock through the link (17), the hammer (4) has been already locked in its tilted state by the sear (5); and when the breech block comes almost back to its initial position, the guide face (18) of the link (17) depresses the upper protrusion (19) of the connector (10) against the pushing force of the urging spring (12). Then, as mentioned in the foregoing, since a beginner often keeps on pulling the trigger (2), the forward end part of the connector (10) rides on the sear (5) and the rear end part which is connected to the trigger (2) with a vertical freely movable preset gap distance between them comes to sway downward. Therefore, the swaying movement of the sear (5) causing the upward rotation of the hammer (4) for firing a next cartridge never takes place under such a condition. After this, the forward end stepped part (10*a*) of the connector (10) comes to engage again with the sear (5) to complete preparation for firing the next cartridge when the trigger (2) has been released from pulling by the shooter.

In the above described arrangement, the connector (10) which slides forward on the sear (5) in response to the trigger (2), is constantly urged upward by the pushing force of the spring 12. On the other hand, the link (17) which is connected to the rear part of the breech block (20) acts to restrict the upward swaying movement of the connector (10). A cartridge firing operation can be accomplished only when no pulling force is applied to the trigger (2) with the upward sway of the connector (10) thus being restricted. After the first firing (or firing of the first cartridge), the preparation for the second firing is completed when the breech block (20) has completed its backward and forward movements inside the receiver and when loading of the next cartridge has been completed after a rotating movement of the next cartridge and also when the trigger (2) has been released from the pulling action of the shooter. Therefore, undesired firing never takes place even when the trigger pulling action of the shooter is caused to discontinue momentarily by the recoil of the gun or a shock resulting from firing. The above described arrangement thus completely eliminates the possibility of a spontaneous firing or a similar accident that otherwise tends to happen.

In the above described embodiment example of the trigger device, the sear which locks the hammer in its tilted position is swayed by a trigger pulling action to release the hammer from the locked position. Further, the safety mechanism provided for preventing firing of a next cartridge until completion of a cartridge rotating action by the breech block comprises the urging spring that charges the connector with an upward pushing force and a loose connecting arrangement provided in the rear end part of the trigger device for absorbing a deforming force resulting from the restriction on the forward end part of the connector to prevent its downward movement. Compared with conventionally known trigger devices, the structural arrangement of the present device is extremely simplified and yet the possibility of an erroneous action relative to the movement of the breech block is completely eliminated. A high degree of safety is ensured by the present device.

EXAMPLE 2

Figure 4:
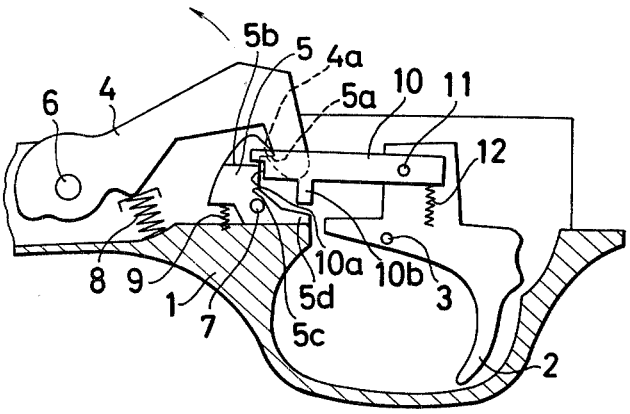
FIG. 4 is a vertical partially sectional view showing another embodiment of this invention as in its state prior to firing.
Figure 5:
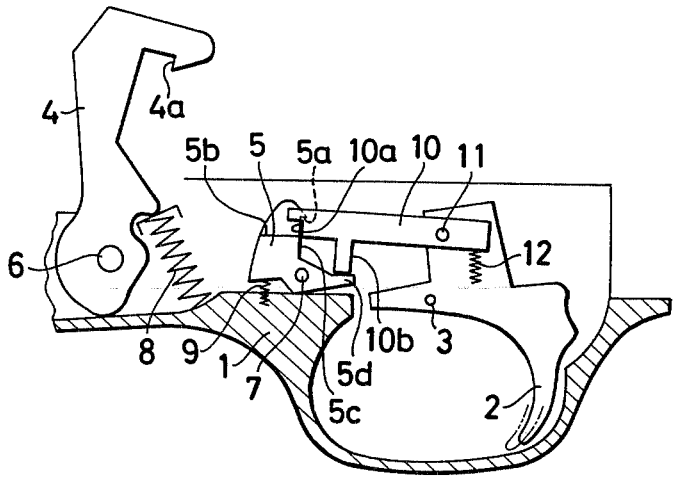
FIG. 5 is a vertical partially sectional view of the embodiment shown in FIG. 4 as in a firing state.
Figure 6:
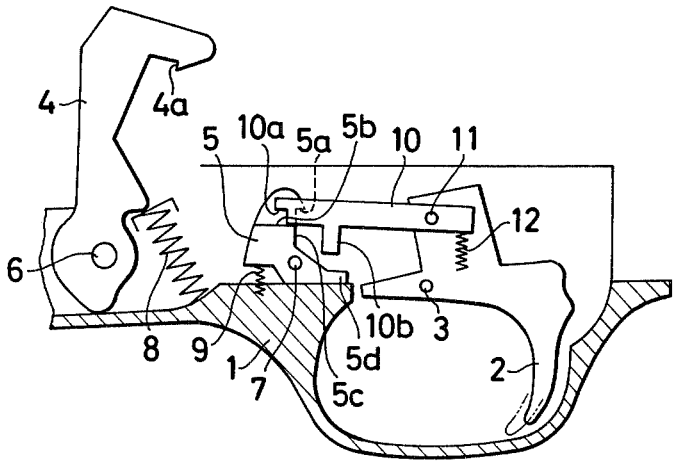
FIG. 6 is a vertical partially sectional view of the same embodiment as in its state after firing.

Referring to FIGS. 4 through 6, a reference numeral (1) indicates a trigger guard attached to a receiver of an automatic gun; (2) indicates a trigger rotatably attached to a pin (3); and (4) and (5) indicate a hammer and a sear rotatably attached to pins (6) and (7) respectively. The hammer (4) is urged to rotate forward in the direction indicated by an arrow by a spring (8) while the sear (5) is urged to sway backward by a spring (9). The hammer (4) and the sear (5) come to engage with each other when the hammer (4) is in a position of having been turned backward as shown in FIG. 4 (hereinafter will be called the first engagement). The hammer (4) is released from this engagement when the sear (5) is rotated forward to a preset degree. A numeral **(4*a*) indicates a claw part of the hammer (4); (5*a*) indicates a claw part of the sear (5); and (10) indicates a connector rotatably disposed on a pin (11) on the upper swinging side of the trigger (2). The connector (10) is provided with a stepped part (10*a*) at its forward end to engage with the upper face (5*b*) and the rear face (5*c*) of the sear (5) as shown in FIG. 4 (will be called hereinafter the second engagement). A reference numeral (10*b*) indicates a leg portion of the connector (10). The lower end of the leg portion (10*b*) engages with a backward extension (5*d*) of the sear (5) and is being pushed upward by the part (5*d*). A numeral (12) indicates a spring which is provided to urge the stepped part (10*a*) of the connector (10)** to move downward.

The above described embodiment of the invention operates in the following manner:

FIG. 4 shows the relative positions of component parts prior to firing a cartridge. Under such a condition, the sear (5) is in its backward biased position to lock the hammer (4) in its tilted state as illustrated. The extension **(5*d*) is in contact with the trigger guard (1) to prevent further backward rotation of the sear (5). The stepped part (10*a*) of the connector (10) is engaged with the upper and rear faces (5*b*) and (5*c*) of the sear (5) because of a pushing force of the spring (12); while there is kept a preset gap distance between the lower end of the leg portion (10*b*) of the connector (10) and the extension (5*d*) of the sear (5)**. In other words, the first engagement and the second engagement are effectuated respectively.

The condition that obtains the moment the trigger (2) is pulled to fire a cartridge is as described below:

When the trigger (2) is pulled to a position shown in FIG. 5, a swaying movement of the pin (11) causes the connector (10) to move forward. Accordingly, the stepped part **(10*a*) of the connector (10) causes the sear (5) to turn forward against the force of the spring (9). Then, when the trigger pulling degree reaches a preset value, the sear is turned to a sufficient degree to release the hammer (4) from its locked state (the first engagement). Since the hammer (4) is urged to turn forward by the force of the spring (8) as mentioned in the foregoing, the hammer (4)** then instantaneously pivots upwardly to hit an unillustrated firing pin to effect firing.

When the sear (5) is turning forwardly, the extension **(5*d*) of the sear (5) comes into contact with the leg portion (10*b*) of the connector (10) to push the connector (10) upward. Then, shortly after the release of the hammer (4), the stepped part (10*a*) of the connector (10) is disengaged from the rear face (5*c*) of the sear (5) (release of the second engagement), so that the sear (5) is instantaneously brought back into its initial position by the pushing force of the spring (9). Accordingly, the connector (1) comes to merely slide on the upper face (5*b*) of the sear (5) as shown in FIG. 6**.

Following this, the breech block is arranged to retract in the same manner as in a conventional automatic gun to turn the hammer (4) backward. Then, the claw part **(4*a*) of the hammer (4) again comes to engage with the claw part (5*a*) of the sear (5)** and there obtains the first engagement.

The length of time between firing of a cartridge and returning of the hammer (4) back to its initial position is extremely short. Then, since the trigger is still being pulled in general, even when the hammer (4) comes into the first engagement with the sear (5), the second engagement between the stepped part **(10*a*) of the connector (10) and the sear (5) still remains disengaged, so that the second firing can not be effected before the trigger (2) is released back to its initial position. Further, in consideration of the possibility of unintended momentary return of the trigger (2) back into its initial position due to a shock of firing before the retract of the breech block, a further safety can be ensured by arrangement to make the second engagement between the sear (5) and the stepped part (10*a*) of the connector (10) possible only when the first engagement between the sear (5) and the hammer (4)** has been effected.

EXAMPLE 3

Figure 7:
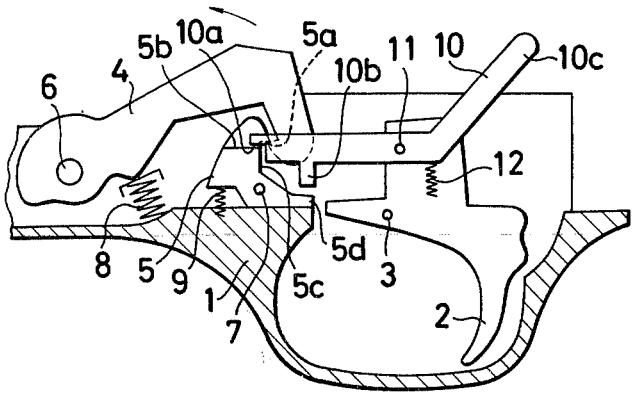
FIG. 7 is a vertical partially sectional view showing a further embodiment of this invention as in its state prior to firing.
Figure 8:
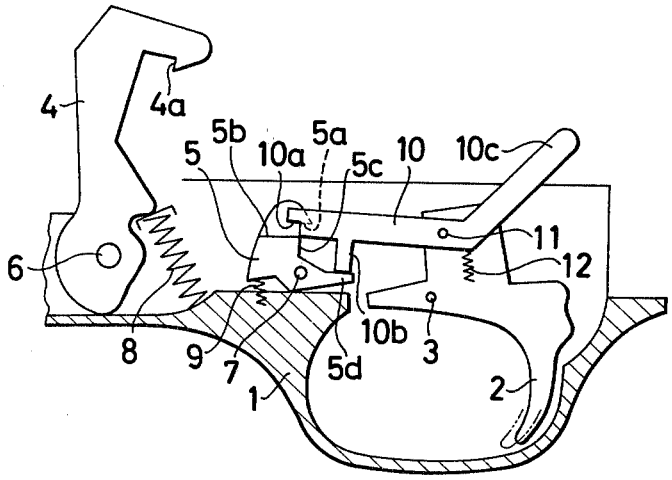
FIG. 8 is a vertical partially sectional view showing the embodiment shown in FIG. 7 as in a firing state.
Figure 9:
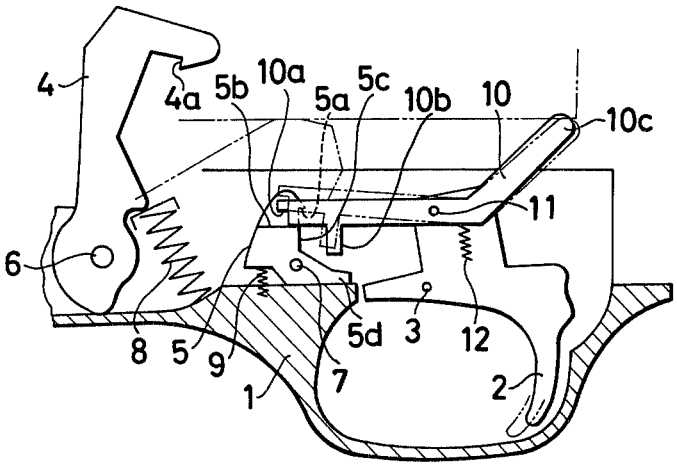
FIG. 9 is a vertical partially sectional view of the same embodiment as in its state after firing.

The trigger device shown in FIG. 7 through FIG. 9 represents a modification of the embodiment example 2. The modification is characterized by the provision of an arm portion **(10*c*) extending upward from the rear end of the connector (10)** of the second embodiment.

The arm portion **(10*c*) is arranged to come into contact with the rear end face of an unillustrated breech block. With this arrangement, the retraction of the breech block causes the connector (10) to rotate to a position behind an arrow indicated in FIG. 7. In other words, the retraction of the breech block is utilized to cause the stepped part (10*a*) of the connector (10)** to spring upward.

With the exception of the above stated part, other parts of this modification are about the same as in the embodiment Example 2. However, in accordance with this modification arrangement, the sear (5) and the stepped part **(10*a*) of the connector (10) are released from their engagement (the second engagement) without fail after a cartridge is fired, so that the possibility of spontaneous firing of the second cartridge due to an abnormal operation can be completely eliminated. Further, the same purpose may be also attained by arranging the extension (5***d*) of the sear (5) to come into contact with the leg portion (10*b*) of the connector (10) in such a manner as to push the connector (10) upward.

Compared with the conventional trigger devices of the prior arts, each of the above described embodiment examples of this invention is simple in construction and yet gives excellent effects. The number of parts required in accordance with this invention is much less than the conventional devices. This is an advantage where high dimensional precision for many component parts is required for the manufacture of such a device. The use of fewer parts also results in reduced possibility of damage of the parts. Then, since improvement in safety is most important for this type of devices, it is also advantageous that a high level of safety can be ensured in accordance with this invention.

What is claimed is:

1. A trigger device for an automatic gun having a firing direction, comprising a receiver, a trigger guard mounted in said receiver, a trigger pivotally attached to said trigger guard and arranged to be pulled by a shooter for firing the gun, a breech block mounted in said receiver upwardly from and forwardly of said trigger relative to the firing direction, a link extending rearwardly from said breech block and spaced upwardly above said trigger, said link having a guide face directed downwardly toward said trigger, said link forming an opening, a connector located between said guide face of said link and said trigger, said connector is elongated in the firing direction and has a forward end portion extending in the firing direction fowardly of said trigger and a rear end portion positioned above said trigger, a pin secured to and extending outwardly from said rear end portion of said connector transversely of the firing direction, said trigger having an upper part disposed in juxtaposition to the rear end portion of said connector, said upper part of said trigger forming an upwardly extending slot therein disposed transversely of the firing direction, said pin extending into said slot and said slot having a length so that a preset free distance path is provided therein for relative movement between said trigger and said connector when said trigger is pulled and pivots relative to said trigger guard, said slot in said upper part of said trigger moves said pin and said connector in the firing direction, a sear rotatively attached to said trigger guard forwardly of said trigger in the firing direction, a spring biasing said sear for rotation in the direction opposite to the firing direction, said sear having an upwardly extending edge facing rearwardly toward said trigger and an upper face located below and directed toward said link, said forward end part of said connector being in juxtaposition to said upwardly extending edge so that said connector pivots said sear against the biasing action of said spring when said trigger is squeezed, said sear having a claw part facing opposite to the firing direction, a hammer pivotally attached to said trigger guard forwardly of said sear and extending rearwardly from the pivot point to adjacent said sear, said hammer having a hook part on the end thereof spaced rearwardly from the pivotal connection and arranged to interengage with said claw part of said sear for holding said hammer in position to fire the gun and said hammer being releasable from said sear when said sear is displaced against the biasing action of said spring associated therewith by said connector, a spring located within said trigger guard and bearing against said hammer for pivotally displacing said hammer forwardly in the firing direction when the interengagement of said sear and hammer is released, a spring mounted on said trigger forwardly in the firing direction from the pivotal connection of said trigger to said trigger guard, said spring mounted on said trigger extends upwardly into contact with said connector and biases said connector upwardly against said guide face on said link, said connector having an upwardly extending protrusion which engages said guide face and restricts the upward biasing action of said spring mounted on said trigger, said breech block and said link being slidably displaceable through said receiver when the gun is fired so that the combination of said breech block and link return said hammer from the released position back into the interengaged position with said sear while the opening in said link allows said connector to move upwardly due to the biasing action of said spring mounted on said trigger so that said connector is displaced upwardly and the forward end portion thereof is unable to contact said sear for effecting firing of the gun.

* * * * *

UNITED STATES PATENT OFFICE

CERTIFICATE OF CORRECTION

Patent No. 4,185,537 Dated Jan. 29, 1980

Inventor(s) Hisao Hayashi

It is certified that error appears in the above-identified patent and that said Letters Patent are hereby corrected as shown below:

In the heading of the patent [73] should read as follows:

[73] Assignee: Kabushiki Kaisha Kawaguchiya
Hayashi Juho Kayaku-Ten, Tokyo, JAPAN Signed and Sealed this

*Twenty-ninth* Day of *April 1980*

[SEAL]

*Attest:*

SIDNEY A. DIAMOND

*Attesting Officer* *Commissioner of Patents and Trademarks*